United States Patent [19]

Ham

[11] Patent Number: 4,914,773

[45] Date of Patent: Apr. 10, 1990

[54] CLEANING APPARATUS

[76] Inventor: Yong S. Ham, Jangmi Apt 12-1105, 7 Shinchun-Dong, Kangnam-Ku, Seoul, Rep. of Korea

[21] Appl. No.: 162,253

[22] Filed: Feb. 29, 1988

Related U.S. Application Data

[63] Continuation-in-part of Ser. No. 19,120, Feb. 26, 1987, abandoned.

[30] Foreign Application Priority Data

Feb. 26, 1986 [KR] Rep. of Korea ..... UM 86-2334

[51] Int. Cl.[4] ..... E01H 1/00

[52] U.S. Cl. ..... 15/3; 15/49 R; 15/51; 15/79 R; 15/80; 15/84; 15/99

[58] Field of Search ..... 15/51, 80, 99, 4, 3, 15/93 R, 84, 49 R, 50 R, 79 R; 56/328 R

[56] References Cited

U.S. PATENT DOCUMENTS

| | | | |
|---|---|---|---|
| 433,538 | 8/1890 | Newlove | 15/93 R |
| 500,221 | 6/1893 | Shively et al. | 15/51 |
| 1,200,092 | 10/1916 | Elliott et al. | 15/80 |
| 1,236,841 | 8/1917 | Holdren | 15/84 |
| 1,310,296 | 7/1919 | Rogers et al. | 15/51 |
| 1,954,314 | 4/1934 | Heitman | 15/51 |

*Primary Examiner*—Edward L. Roberts

*Attorney, Agent, or Firm*—Birch, Stewart, Kolasch & Birch

[57] ABSTRACT

An improved cleaning apparatus for use in cleaning the floor which comprises a first belt as a broom, a second as a mop and a trash containing corner whereby as the cleaning apparatus is pushed the wheels, the conveyor belt and wiping belt are driven so as to perform the functions of sweeping, wiping, and effectively protecting the trash from dropping therefrom.

7 Claims, 1 Drawing Sheet

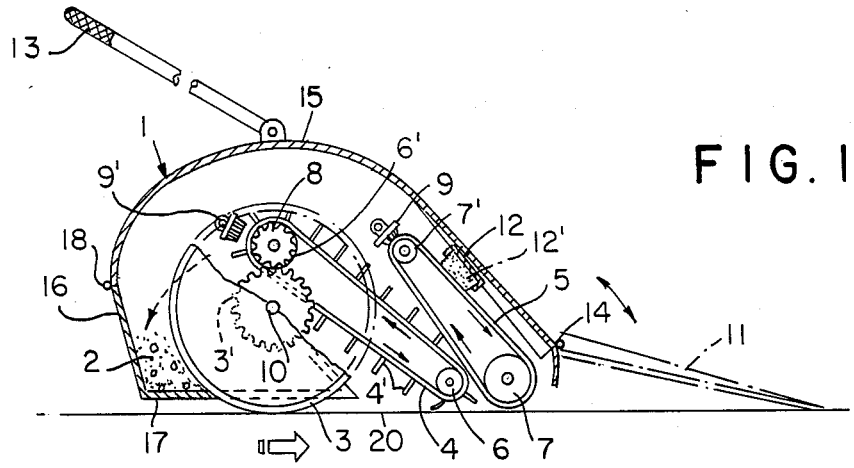
FIG. 1
FIG. 2
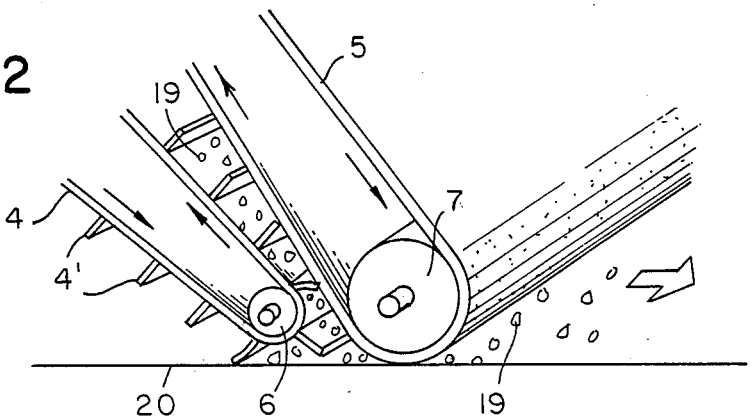
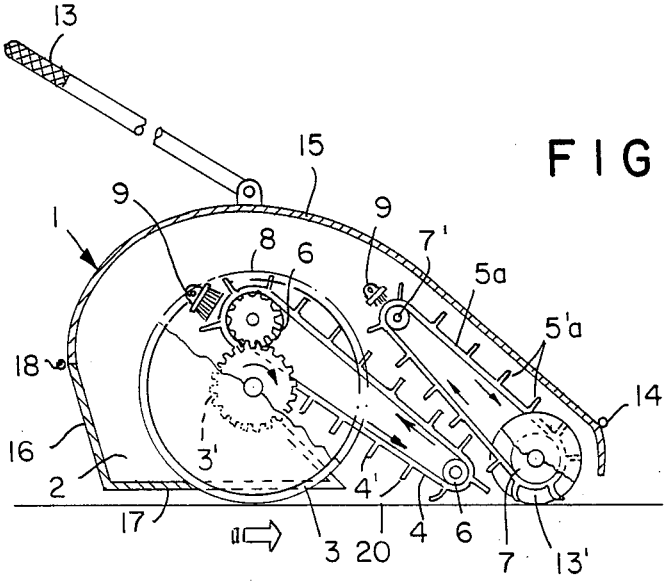
FIG. 3

CLEANING APPARATUS

CROSS REFERENCE TO RELATED APPLICATION

This application is a continuation-in-part of Application Serial No. 019,120 filed Feb. 26, 1987, for "CLEANING DEVICE", which is now abandoned.

BACKGROUND OF THE INVENTION

1. Field of the Invention

The present invention relates to a cleaning device and more particularly, to a cleaning apparatus having the triple function of sweeping and wiping a floor and effectively protecting the trash from dropping to the floor from the apparatus. The apparatus can be operated with little effort being required by the operator.

2. Description of the Prior Art

There are many types of cleaning devices which are well known in art comprising individual wiping devices or individual sweeping devices or, a combined wiping and sweeping device assembly. Such cleaning devices are shown in U.S. Pat. Nos. 433,538 to Newlove, 500,221 to Shively et al, 1,310,296 to Rogers et al, and 1,954,314 to Heitman. However, these cleaning devices suffer from a number of problems such as, for example, since, when the cleaning devices are jolted, the trash drops from the cleaning apparatus, thus the cleaning devices cannot effectively clean a floor.

SUMMARY OF THE INVENTION

Accordingly, it is an object of the present invention is to provide an improved cleaning apparatus having the triple functions, that is, sweeping and wiping for cleaning the floor and protecting the trash from dropping therefrom.

Another object of the present invention is to provide a cleaning apparatus which includes a wiping belt as a mop and a conveyor belt as a broom which are rotated in opposing directions to each other for effectively protecting the dirt from dropping from the cleaning apparatus.

A further object of the present invention is to provide a cleaning device which contains a trash containing corner for collecting the trash obtained from the cleaning operation.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention relates to an improved cleaning apparatus for use in cleaning the floor which comprises a conveyor belt as a broom, a wiping belt as a mop, and a trash containing corner whereby the cleaning apparatus can be utilized to effectively sweep and wipe the simultaneously protect the dirt from dropping from the cleaning apparatus when the cleaning apparatus conducts a single pass over the surface of the floor. Also, little effort is required by the operator.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a side elevational view of the cleaning apparatus of the present invention showing in cut away portions thereof;

FIG. 2 is an enlarged perspective view of conveyor and wiping belts showing mutual relation to each other of the present invention; and FIG. 3 is a side elevational view of another embodiment of the present invention showing in a cut away portions thereof.

DETAILED DESCRIPTION OF THE INVENTION

Referring now in detail to the drawings for the purpose of illustrating the present invention, the cleaning apparatus 1 as shown in FIGS. 1 and 3 comprises wheels 3 having coaxial gears 3, and a shaft 10, and a conveyor belt 4 connected to first conveyor guiding rollers 6' secured to driving gear 8 which gears with the coaxial gears 3'. A wiping belt 5 operatively contacts the conveyor belt 4 at a location in front of second conveyor guiding rollers 6 of the conveyor belt 4. The conveyor belt 4 includes a plurality of conveying members 4' disposed thereon for conveying the trash from the floor to the trash containing corner 2. The wiping belt 5 engages first wiping guiding rollers 7' and the second wiping guiding rollers 7. The conveyor belt 4 and wiping belt 5 rotates, respectively, in the opposing direction to each other for effectively storing the trash in a plurality of chambers between the plurality of conveying members 4' while the apparatus 1 are operated by the user.

Brushes 9 are associated with the conveyor belt 4 and wiping belt 5, respectively, for cleaning off the dust, dirt, trash, or the like from the belts 4 and 5.

A sponge container 12 is associated with a wet sponge 12' for supplying liquid to the wiping belt 5. The trash recovered by the cleaning apparatus 1 collects in the corner of the trash containing corner 2. The cleaning apparatus 1 is also provided with a handle 13.

As shown in FIG. 1, a front cover or dustpan 11 which is attached by hinges 14 and extends over a second guiding rollers 7 of the wiping belt 5. A cover 15, to which the handle 13 is secured, extends over the shaft 10 of the wheels 3. The rear cover 16 connects to a base member 17 to form the trash containing corner 2 disposed at the corner portion between the rear cover 15 and the base member 17. The rear cover 16 is connected to the cover 15 through hinges 18.

The sponge container 12 attached to the interior surface of the cover 15 in vicinity of the portion of the wiping belt 5 is provided with a wet sponge 12' disposed therein for supplying moisture to the wiping belt 5 through sliding contact with each other. The conveyor belt 4 includes the plurality of conveying members 4' for distribution the dust, dirt and trash 19 from a floor 20 to the corner container 2. While the cleaning apparatus of the present invention is operated, the trash is transferred to a plurality of chambers disposed between the conveying members 4' and simultaneously, the wiping belt 5 covers the chamber for effectively protecting the trash from dropping from the cleaning apparatus 1. The coaxial gears 3' gear with driving gears 8 which include the first conveyor rollers 6' as a coaxis for rotating the conveyor belt 4 operatively associated with the second conveyor roller 6.

Referring in detail to FIG. 3, there is illustrated another embodiment of a cleaning apparatus 1 in accordance with the present invention. If there is demand to clean a large amount of the trash on the floor 20, the cleaning apparatus 1 can comprise an auxiliary belt 5*a* having a plurality of conveying members 5*a'* which engage with the second guiding rollers 7 of the auxiliary belt 5*a*. Also, coaxial gear wheels 13' can be rotated on the floor 20 for easily operating the auxiliary belt 5. Therefore, the conveyor and auxiliary belts 4 and 5*a* having both plurality of conveying members 4' and 5*a'*, respectively, are operated in cooperation for the transportation of the trash 19 from the floor 20 to the trash containing corner 2.

According to the present invention, the cleaning apparatus operates as follows: Water or a cleaning oil is supplied to the sponge container 12 predetermined by the cleaning purpose of the floor 20. At this time, when the user pushes the cleaning apparatus 1 using the handle 13, the wheels 3 rotate, the coaxial gears 3' rotate which in turn rotate the driving gears 8. The gears 3' make the driving gears 8 rotate which correspondingly rotate the first conveyor guiding rollers 6'. The second conveyor guiding rollers 6 are rotated through the conveyor belt 4. Also, the second wiping guiding rollers 7 are rotated by the pushing force of the operator. The dust and/or trash 19 is collected by the conveyors and wiping belts 4 and 5 and separated from the belt 4 to the trash containing corner 2 by cleaning the belt 4 with the brush 9'. At that time, as shown in FIG. 1, the wiping belt 5 rotates, and the belt 5 coated by the water or cleaning oil slidably contacts with the floor 20 for wiping and cleaning the floor 10. Accordingly, the floor 19 is wiped by the belt portion disposed at the second wiping guiding rollers 7 (FIGS. 1 and 2).

Also, according to another embodiment of the present invention, the floor 19 may be cleaned by the conveyor and auxiliary belts 4 and 5*a* having the plurality of conveying members 4' and 5*a'* (FIG. 3).

Because the cleaning apparatus of the present invention includes both a sweeping system and a wiping system disposed therein for simultaneously cleaning up the floor, it is very convenient for cleaning and is inexpensive to purchase. Also, it takes only a short time to clean a surface by utilizing the cleaning apparatus of the present invention when compared with conventional cleaning devices. Furthermore, the cleaning apparatus having the conveyor belt 4 which is operatively associated with the wiping belt 5 or the auxiliary belt 5*a* for effectively transporting the dust, dirt, trash or the like 19 to the trash containing corner 2 since the belts 4 and 5 or 5*a* tightly contact to store the trash 19 in the chambers formed therebetween even though the apparatus 1 is suddenly jolted.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A cleaning apparatus for use in cleaning a floor which comprises:

a housing, rear wheels having wheel gears coaxial therewith, being disposed in said housing, first guiding rollers disposed in said housing, being operatively connected to driving gears, said driving gears being operatively engaged with said wheel gears, second guiding rollers disposed in said housing near the floor relative to said first guiding rollers, being operatively associated with said first guiding rollers, a conveyor belt, disposed in said housing, having a plurality of conveying members disposed thereon which rotates about said first guiding rollers and second guiding rollers, wherein said conveyor belt is driven by said wheels through engagement of said wheel gears, driving gears, and first and second rollers, third guiding rollers disposed near said first guiding rollers and fourth guiding rollers disposed adjacent to said second guiding rollers in said housing, a wiping belt disposed adjacent and parallel to said conveyor belt in said housing, said wiping belt operatively rotating about said third and fourth guiding rollers, and rotating in the opposite direction of said conveyor belt so as to cooperate with said conveyor belt, a wet sponge disposed in said housing so as to operatively contact said wiping belt, trash collecting means disposed in said housing for receiving trash which is conveyed from said conveyor belt, and a handle for pushing the cleaning apparatus whereby as the cleaning apparatus is pushed the wheels cause said first rollers to rotate through said gears and the conveyor belt and wiping belt are cooperatively driven so as to perform the functions of sweeping by rotation of the conveyor belt, wiping by rotation of the wiping belt, and collecting of trash by the movement of the plurality of conveying members for effectively retaining the trash in the cleaning apparatus.

2. The cleaning apparatus of claim 1, further comprising cleaning brushes adapted to engage each of the conveyor and wiping belts at the first and third guiding rollers, respectively.

3. The cleaning apparatus of claim 1, wherein a cover is disposed over the wheels and the handle is secured to said cover.

4. The cleaning apparatus of claim 1, wherein the wiping belt is provided with a front cover which is hinged at the front portion of the cleaning apparatus.

5. A cleaning apparatus for use in cleaning a floor which comprises:

a housing, rear wheels having wheel gears coaxial therewith, being disposed in said housing, first guiding rollers disposed in said housing, being operatively connected to driving gears, said driving gears being operatively engaged with said wheel gears, second guiding rollers disposed in said housing, being operatively associated with said first guiding rollers, a conveyor belt, disposed in said housing near the floor relative to said first guiding rollers, having a plurality of conveying members disposed thereon which rotates about said first guiding rollers and second guiding rollers, wherein said conveyor belt is driven by said wheels through engagement of said wheel gears, driving gears, and first and second rollers, third guiding rollers disposed near said first guiding rollers and fourth guiding rollers disposed adjacent to said second guiding rollers in said housing, an auxiliary belt, disposed adjacent and parallel to said conveyor belt in said housing, having a plurality of conveying members, said auxiliary belt operatively rotating about said third and fourth guiding rollers, and rotating in the opposite direction of said conveyor belt, front wheels associated with a coaxis of said fourth guiding rollers, trash collecting means disposed in said housing for receiving trash which is conveyed from said conveyor belt, and a handle for pushing the cleaning apparatus whereby as the cleaning apparatus is pushed the wheels cause said first rollers to rotate through said gears and the conveyor belt and wiping belt are cooperatively driven so as to perform the functions of sweeping by rotation of the conveyor belt wiping by rotation of the wiping belt, and collecting of trash by the movement of the plurality of conveying members for effectively retaining the trash in the cleaning apparatus.

6. The cleaning apparatus of claim 5, wherein the collecting means is disposed at the corner between a rear cover and a base member.

7. The cleaning apparatus of claim 5, wherein a cover is disposed over the wheels and the handle is secured to said cover.

* * * * *